United States Patent [19]

Berghammer et al.

[11] 4,416,298

[45] Nov. 22, 1983

[54] ELECTRICAL IGNITION SYSTEM FOR CATALYTICALLY HEATED CURLING DEVICE

[75] Inventors: Conrad Berghammer, Kronberg; Walter Schäfer, Frankfurt am Main; Rolf Stühler, Wiesbaden-Delkenheim, all of Fed. Rep. of Germany

[73] Assignee: Braun Aktiengesellschaft, Kronberg, Fed. Rep. of Germany

[21] Appl. No.: 356,566

[22] Filed: Mar. 9, 1982

[30] Foreign Application Priority Data

Dec. 3, 1981 [DE] Fed. Rep. of Germany ..... 3109353

[51] Int. Cl.[3] ..... A45D 2/12

[52] U.S. Cl. ..... 132/33 R; 132/37 R

[58] Field of Search ..... 132/37 R, 32 R, 9, 33 R

[56] References Cited

U.S. PATENT DOCUMENTS

| | | | |
|---|---|---|---|
| 2,997,869 | 8/1961 | Weiss . | |
| 3,358,733 | 12/1967 | Manning . | |
| 3,478,755 | 11/1969 | Jorgensen . | |
| 3,563,251 | 2/1971 | Jorgensen . | |
| 3,913,592 | 10/1975 | Morane et al. . | |
| 3,934,114 | 1/1976 | Godel | 132/32 R |
| 4,227,541 | 10/1980 | Satchell | 132/37 R |
| 4,243,017 | 1/1981 | Diederich . | |
| 4,248,208 | 2/1981 | Diederich | 132/32 R |
| 4,354,482 | 10/1982 | Beisecker | 132/37 R |

FOREIGN PATENT DOCUMENTS 419825 11/1934 United Kingdom .

*Primary Examiner*—Gregory E. McNeill
*Attorney, Agent, or Firm*—Robert A. Shack

[57] ABSTRACT

A hair curler for rolling up the hair having a cylindrical rod body containing a catalytic heating device. The rod body is permanently affixed on a handle which is designed as a fuel tank. A thermostatically controlled valve device, between the fuel tank and the rod body, regulates the fuel supply from the fuel tank to the catalytic heating device. An opening allows air to enter the chamber which contains the catalyst. An ignition device is situated at the free end of the cylindrical rod body. The ignition device is activated by means of an operating key which closes an electrical circuit, to heat an incandescent filament, and thus to initiate catalytic combustion at the catalyst. A chamber is situated between the battery and the combustion chamber. This chamber is flushed through by ambient air and inhibits heat flow. The electrical conductors of the ignition device are conducted through this chamber.

4 Claims, 1 Drawing Figure

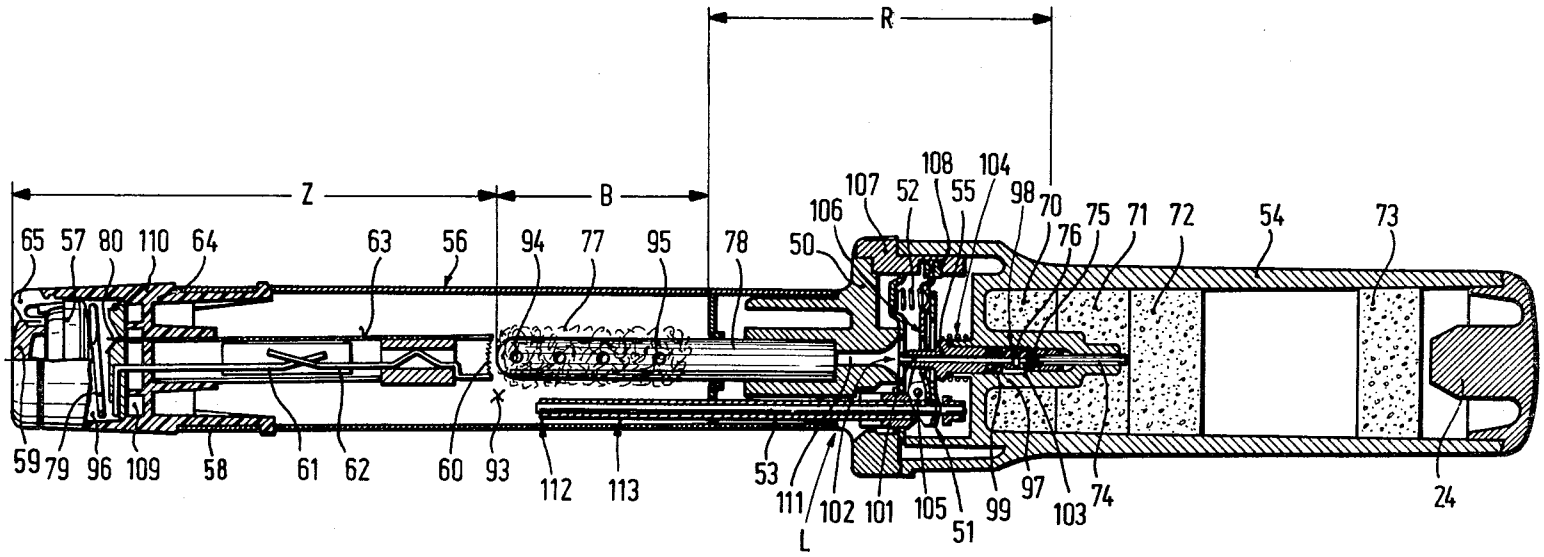
24
73
54
72
71
75
76
70
98
104
55
108
52
107
106
50
78
95
77
94
56
63
64
110
80
57
65
74
103
97
99
51
105
101
102
111
53
113
112
93
60
62
61
58
109
96
79
59
R
B
Z
L

ELECTRICAL IGNITION SYSTEM FOR CATALYTICALLY HEATED CURLING DEVICE

BACKGROUND OF THE INVENTION

This invention relates to hair curling devices which are catalytically heated. More particularly, this invention relates to a curling iron with a self-contained fuel supply and an improved electrical ignition system.

Curling devices such as hair curlers are known to include catalytic heaters which were activated when the catalytic material is exposed to air. These devices are typified in British Pat. No. 419,825 and U.S. Pat. Nos. 2,997,869; 3,478,755; and 3,358,733.

U.S. Pat. Nos. 3,563,251 and 3,913,592 illustrate hair curlers which are ignited using separate ignition apparatus. For example, the 3,563,251 device initiates a catalytic combustion by supplying an electric current to a filament of a first catalyst positioned proximate the main catalyst mass. The catalyst filament receives its electric current from a filler container at the same time that the hair curler is filled with liquid fuel. Aside from the difficulties of connecting and insulating the electrical connection, this device has the disadvantage of becoming very fragile. The filament element is incandescent throughout the duration of use of the curler and rapidly becomes fragile, resulting in an unreliable hair curler.

The 3,913,592 device is a heated hair roller which is ignited by creating a hot point from an accessory appliance inserted into the hair curler to a position proximate the catalyst. The accessory appliance is preferably a piezoelectric or optical lighter. Aside from the disadvantage of requiring separate ignition and filling for each hair curler application and its concomitant handling difficulties by a user, such a system is costly and complex and may lead to an unreasonable amount of time to form curls in the hair of the user, with consequential general consumer dissatisfaction. Prior art devices, such as those which included nozzles for releasing a gaseous fuel, e.g. British Pat. No. 419,825; and U.S. Pat. Nos. 2,997,869; 3,563,251; and 3,913,592 are generally difficult to manufacture. The device of U.S. Pat. No. 3,563,251 requires its nozzle opening to be within a range of about 15 to 80 microns and formed preferably by the use of a laser.

An invention disclosed in U.S. Pat. No. 4,243,017 entitled "Catalytically Heated Curling Device with Improved Ignition system", which is incorporated herein by reference, solves such prior art difficulties and disadvantages by providing a curling iron which includes a catalyst means with a self-contained mechanical ignition system for initiating oxidation of the vaporized fuel/air mixture in the presence of the catalyst. In a specific embodiment, a telescopically mounted tip housing which included an ignition means having a mechanical snap action, push activated mechanism is provided.

In co-pending U.S. application, Ser. No. 167,631, filed July 22, 1980, entitled "Rotary Ignition System For a Catalytically Heated Curling Device" and assigned to the assignee of the present case, the disclosure of which is incorporated herein by reference, a rotary ignition device is disclosed which has certain advantages over the mechanical snap action mechanism disclosed in U.S. Pat. No. 4,243,017. The rotary igniter of U.S. application Ser. No. 167,631 does not require a pushing of its tip which may cause an axial displacement of the curling rod such as if reignition is desired while a tress of hair is wound about the barrel of the curling rod. Further, a rotary activated ignition system may be preferable in that if the curling iron is dropped and lands on its tip, the snap action mechanism of U.S. Pat. No. 4,243,017 is more likely to incur structural damage and cause an unwanted tripping of the ignition mechanism.

In a co-pending U.S. patent application, Ser. No. 282,332, filed July 10, 1981, an improved mechanical rotary ignition device with certain advantages over the rotary ignition device disclosed in co-pending application Ser. No. 167,631 is also disclosed.

Mechanical ignition devices, for catalytically heated curling devices, may have reliability problems concomitant with moving parts. Further they typically utilize a flint which may cause sparks to be visable from outside the curling device.

An electrical ignition device for a catalytically heated curling device, which does not require an accessory appliance, is disclosed in a co-pending U.S. patent application Ser. No. 282,331, filed July 10, 1981, entitled "Electrical Ignition System For a Catalytically Heating Device" and assigned to the assignee of the present case, the disclosure of which is incorporated by reference. The electrical ignition of Ser. No. 282,331 provides a self-contained electrical ignition means, including a battery, mounted in the tip of the curling iron. When a spring loaded button member is depressed, electrical contact is made between the battery and an incandescent filament. The filament is proximate a catalytic heating means. When the filament is activated, oxidation of the vaporized fuel/air mixture, in the presence of the catalyst, is initiated.

Although the electrical ignition of Ser. No. 282,331 is an improvement in the art, there is the possibility that the heat generated in the combustion chamber of the curling device would have a deleterious effect on the life of the battery.

The foregoing problems have been substantially eliminated by providing in a preferred embodiment of this invention a catalytically heated curling device having an electrical ignition system including a battery. A chamber, which is open to the ambient air, is situated between the battery chamber and the combustion chamber. A portion of the electrical conductors from the battery to the incandescent filament passes through the chamber. Ignition is activated by pressing an operating key or button which moves the spring loaded battery to close an electric circuit to heat the filament, which initiates the catalytic combustion at the catalyst.

SUMMARY OF THE INVENTION

It is an object of this invention to provide a curling device, independent of the line, which utilizes an electrical self-contained ignition system, having a battery, and an ambient air chamber, located in the tip between the battery chamber and combustion chamber of the curling device, to protect the battery.

It is a further object of this invention to provide a highly reliable, easy-to-manufacture electrical ignition device for a catalytically heated curling device which includes an ambient air chamber positioned between the battery chamber and the combustion chamber to protect the battery from the heat effects of the combustion chamber.

Briefly stated and according to an aspect of this invention, the foregoing objects and advantages are achieved by providing a self-contained electrical ignition system for a catalytically heated curling device which includes a battery, in a battery chamber, and an air chamber which is open to the ambient air between the battery chamber and the combustion chamber. The air chamber inhibits heat flow and substantially prevents the heat generated in the combustion chamber from harming the battery. When a button member is pushed, the spring loaded battery activates an incandescent filament, such as a platinum wire. The filament is proximate the catalyst and, once activated, initiates oxidation of a vaporized fuel/air mixture.

In a preferred embodiment, an electrical conductor, which constantly connects the battery to the incandescent filament, is formed, at least partly, from a material with poor heat conductivity. The heat transmitted by the electrical conductor to the battery is thus minimal. In the preferred embodiment, a section of both electrical conductors pass through the heat flow inhibiting air chamber to further minimize heat transfer back to the battery.

During the ignition process, one of the electric conductors connects the incandescent filament to the electrical battery. This electric conductor preferably has a tubular shape, at least in part, which aids in heat dissipation. The battery is not heated through the tubular electrical conductor, since it is only during the ignition process that a direct connection exists through the tubular conductor, between the incandescent filament and the combustion chamber on the one hand and the battery on the other hand.

It is especially advantageous to mount the battery in a battery chamber. Ignition is initiated by pressing an operating button or key, so that the battery, in turn, is moved against a spring force in the longitudinal direction of the device. The housing of the battery chamber is formed of an electrically insulating material. The battery-sided end of one electric conductor is bent in a spiral shape to form a flat pressure spring in the area of the battery chamber and to contact the battery housing thereby spring loading the battery. The battery-sided end of the other electrical conductor, which is held by the housing of the battery chamber, extends into the battery chamber through a lug, and contacts the other pole of the electric battery during the ignition process.

BRIEF DESCRIPTION OF THE DRAWING

This invention both as to its organization and principles of operation, together with further objects and advantages thereof, may better be understood by referring to the following detailed description of an embodiment of the invention taken in conjunction with the accompanying drawing of a longitudinal section of a hair curling unit having an electric ignition device, in accordance with this invention.

DETAILED DESCRIPTION

The hair curler essentially comprises the following: a cylindrical rod body 56; a fuel tank 54, (filled with fuel), connected with the rod body 56; a stopper 24 with a filling valve, (not shown), closing the fuel tank 54 at the rear; an ignition support 64, closing the rod body 56 toward the front; an ignition device, which is designated by Z in its entirety; a combustion chamber, which is held within the rod body 56 and which is designated in its entirety by B; a heating chamber, designated by 93; a base body 50, situated between the rod body 56 and the fuel tank 54, on which a hair clamp with an operating key (not shown) is tiltably mounted; and the valve element 55 with a control device which consists of control lever 51, control spring 52, valve element 55, wick 74, sintered metal stopper 75, rubber disc 76, hole 101, valve nozzle 102, valve opening 103, spring 104, valve lever 106, positioning element 107, control curve 108, and which is designated in its totality by R.

The ignition device Z operates by means of an electric battery 57, positioned in a battery chamber 65 which is held at the free end 58 of the cylindrical rod body 56 in the ignition support 64. The ignition support 64, which is made of an electrically insulating material, is equipped with electrical lines or conductors 61, 62, 63 and with a contact spring 79, through which the ignition current runs from the battery 57 to the incandescent filament 60.

A portion of the electrical conductor 61 and a lug 80 of electrical conductor 63 are in an air chamber 109. Air chamber 109, which inhibits heat flow back to the battery 57, is opened to ambient air through opening 110. In order to switch on the electrical ignition device, one depresses an electrically air conductive operating button or key 59, i.e. it is moved in the longitudinal direction of the device against the force of the contact spring 79, until the lug 80 touches the battery 57 and abuts it solidly to make an electrical connection. The battery current now flows from the battery 57 through the contact spring 79, through the electrical line 61, 62, and through the lug 80 and the tubular electrical line 63, to the incandescent filament 60. When the circuit is closed, the incandescent filament 60 now effects ignition of the fuel/air mixture that is flowing into the combustion chamber B, so that the catalytic oxidation process in a catalyst 77 is initiated.

The catalyst 77 consists of a stocking-like structure of quartz wool, which is coated with platinum. Here, the quartz wool, which has been pressed into the stocking-like structure, is pushed onto a thin-walled burner tube 78. The latter is substantially closed toward the front, i.e. in the direction toward the ignition device Z, and includes several holes, 94, 95, for the fuel gas to exit.

The fuel tank 54 is designed as a handle. It is closed to the air by means of the stopper 24, and is bounded on the front by a valve body 97. The valve body 97 has a valve nozzle 98, within which the spring-loaded valve element 55 is mounted in such a fashion as to be movable longitudinally. The valve element 55 is seated against the valve nozzle 98 by means of a gasket 99. The rearward end of the valve element 55 has a rubber disk 76 which, in the position shown, closes the fuel exit through a hole 101 and a valve nozzle 102. The sintered metal stopper 75 evaporates fuel, which is conveyed from the wick 74 to the valve opening 103. Foam bodies 70, 71, 72 and 73 purify the fuel contained in the fuel tank 54 and convey the fuel to the wick 74—especially when the fuel tank is only partially full.

The valve element 55 is pushed into the open position by the spring 104 (i.e. is moved leftward so that the fuel gas can exit at valve nozzle 102). This happens when the valve lever 106, which is tiltably mounted on a pin 105, is pivoted leftwards by the positioning element 107 with the control curve 108 against the force of the control spring 52 (and thus disengages from its contact at the control lever 51). In the open position of the valve nozzle 102, the fuel gas flows through a mixing tube 111 into the burner tube 78 and through the holes 94, 95 to the catalyst 77, where it burns flamelessly. Air inlet L allows air to enter the chamber which contains the catalyst. When the temperature in the combustion chamber rises, the control rod 53 is shortened. The control rod 53 is connected to a control tube 113 at connection point 112. The length of the control rod 53 is shortened to such an extent that the control lever 51, which is tiltably mounted on the pin 105, is moved toward the right so that the valve element 55 is pushed into its closed position against the force of the spring 104. As long as the valve lever 106 remains pivoted towards the left, the control mechanism comprising the control lever 51, the control rod 53, the connection point 112, and the control tube 113 can freely regulate the exit of gas from the valve nozzle 102. In the position shown in the drawing, the control lever 51 is blocked in its closed position.

While various aspects of the invention have been illustrated by the foregoing detailed embodiment, it will be understood that various substitutions of equivalents may be made without departing from the spirit and scope of the inventions.

What is claimed as new and desired to be secured by Letters Patent of the United States is:

1. In a curling device having a tubular body defining a combustion chamber therein, and having first and second ends and a hair winding portion disposed between the first and second ends and surrounding the combustion chamber, heating means including a catalyst means disposed in the combustion chamber, a housing member proximate the tubular body including fuel supply means for storing a fuel in a liquid state, and aspirating means coupled between the fuel supply means and the combustion chamber for vaporizing the fuel and for mixing the vaporized fuel with air and for supplying a vaporized fuel/air mixture to said catalyst means, self-contained electrical ignition means mounted in the first end of the tubular body proximate the catalyst means for initiating oxidation of the vaporized fuel/air mixture in the presence of the catalyst means, the improvement comprising:

a battery chamber, including a battery, mounted in said electrical ignition means;

an air chamber disposed between said battery chamber and said combustion chamber for inhibiting heat flow between said battery chamber and said combustion chamber, said air chamber being substantially sealed from both said battery chamber and said combustion chamber and having an opening only to ambient air outside said tubular body;

an accessable button member located in the tip of said first end of said tubular body;

an incandescent filament, proximate said catalyst means, for oxidizing the vaporized fuel/air mixture in the presence of said catalyst means; and conductive means providing an electrical connection between said battery and said incandescent filament, when said button member is pressed, thereby electrically activating said incandescent filament.

2. The curling device as in claim 1 wherein said conductive means includes a first conductor connected between said battery and said incandescent filament, and a second conductor having a lug portion, a portion of said first and second conductors being formed from an electrically conductive material with poor heat conductivity.

3. The curling device as in claim 2 wherein a portion of said second conductor is generally tubular in shape.

4. The curling device as in claim 2 wherein said end of said first conductor abutting said battery includes a spiral portion for spring loading said battery against said button member, and wherein said spiral portion of said first conductor and said lug portion of said second conductor extend into said air chamber.

* * * * *